US011472202B2

(12) United States Patent
Yamada

(10) Patent No.: US 11,472,202 B2
(45) Date of Patent: Oct. 18, 2022

(54) MEDIUM HEATING DEVICE WHICH INTERMITTENTLY APPLIES HEAT TO A CONTACT HEATER AND AN INFRARED HEATER

(71) Applicant: Masafumi Yamada, Kanagawa (JP)

(72) Inventor: Masafumi Yamada, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/443,463

(22) Filed: Jul. 27, 2021

(65) Prior Publication Data

US 2022/0063303 A1 Mar. 3, 2022

(30) Foreign Application Priority Data

Aug. 28, 2020 (JP) ..... JP2020-144713

(51) Int. Cl.
*B41J 11/00* (2006.01)

(52) U.S. Cl.
CPC .... *B41J 11/00216* (2021.01); *B41J 11/00244* (2021.01)

(58) Field of Classification Search
CPC ..... B41J 11/00216; B41J 11/00244
See application file for complete search history.

(56) References Cited

U.S. PATENT DOCUMENTS 9,327,524 B1 5/2016 Yamada et al.
10,384,472 B2 * 8/2019 Onodera ..... B41J 11/00212
2016/0114600 A1 4/2016 Yamada et al.
2017/0266986 A1 9/2017 Yamada
2019/0100032 A1 4/2019 Nakai et al.
2019/0275812 A1 9/2019 Moriya et al.
2019/0283471 A1 * 9/2019 Kobayashi ..... B65H 18/103
2020/0101766 A1 4/2020 Kizaki et al.
2020/0103794 A1 4/2020 Kizaki et al.
2020/0164662 A1 5/2020 Yamada et al.
2021/0122171 A1 * 4/2021 Yamada ..... B41J 11/0024

FOREIGN PATENT DOCUMENTS

JP 2010-030313 2/2010
JP 2019-162773 9/2019
JP 2020-082570 6/2020

* cited by examiner

*Primary Examiner* — Bradley W Thies
(74) *Attorney, Agent, or Firm* — Xsensus LLP

(57) ABSTRACT

In a medium heating device, a medium is conveyed along a conveyance path. A first contact heater contacts a back surface of the medium. A second contact heater is disposed downstream from the first contact heater in a conveyance direction of the medium and contacts the back surface of the medium. A non-contact heater faces the second contact heater across the conveyance path and heats a front surface of the medium at a position separated from the medium on the conveyance path. In an operation period in which the medium is intermittently conveyed on the conveyance path, circuitry supplies power to each of the first contact heater, the second contact heater, and the non-contact heater to generate heat, and the power supplied to the second contact heater is smaller than the power supplied to the first contact heater.

6 Claims, 10 Drawing Sheets

MEDIUM HEATING DEVICE WHICH INTERMITTENTLY APPLIES HEAT TO A CONTACT HEATER AND AN INFRARED HEATER

CROSS-REFERENCE TO RELATED APPLICATION

This patent application is based on and claims priority pursuant to 35 U.S.C. § 119(a) to Japanese Patent Application No. 2020-144713, filed on Aug. 28, 2020, in the Japan Patent Office, the entire disclosure of which is hereby incorporated by reference herein.

BACKGROUND

Technical Field

Aspects of the present disclosure relate to a medium heating device and a liquid discharge apparatus incorporating the medium heating device.

Description of the Related Art

There is known a liquid discharge apparatus including a liquid discharge unit that discharges a liquid onto a medium and a conveyor that conveys the medium to which the liquid discharged from the liquid discharge unit adheres. In addition, the liquid discharge apparatus may include a dryer that dries the liquid adhering to the medium.

SUMMARY

Embodiments of the present disclosure describe an improved medium heating device that includes a conveyance path, a first contact heater, a second contact heater, a non-contact heater, and circuitry. The medium having a front surface to which a liquid adheres and a back surface opposite to the front surface. The medium is conveyed along the conveyance path. The first contact heater contacts the back surface of the medium. The second contact heater is disposed downstream from the first contact heater in a conveyance direction of the medium and contacts the back surface of the medium. The non-contact heater faces the second contact heater across the conveyance path and heats the front surface of the medium at a position separated from the medium on the conveyance path. The circuitry supplies power to each of the first contact heater, the second contact heater, and the non-contact heater to generate heat. In an operation period in which the medium is intermittently conveyed on the conveyance path, the circuitry supplies the power to each of the first contact heater, the second contact heater, and the non-contact heater, and the power supplied to the second contact heater is smaller than the power supplied to the first contact heater.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
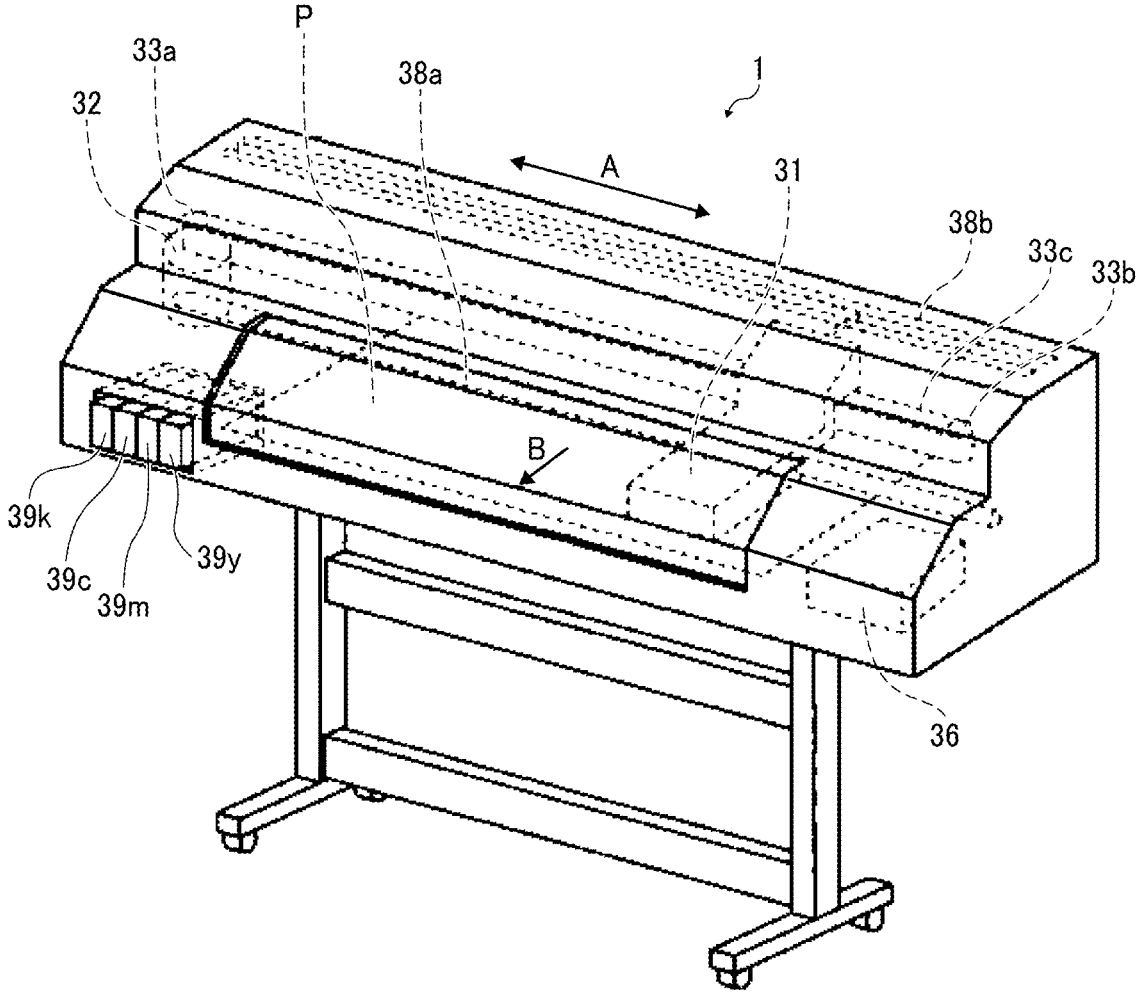
FIG. 1 is a perspective view illustrating a configuration of an inkjet recording apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a," "an," and "the" are intended to include the plural forms as well, unless the context clearly indicates otherwise.

It is to be noted that the suffixes y, m, c, and k attached to each reference numeral indicate only that components indicated thereby are used for forming yellow, magenta, cyan, and black images, respectively, and hereinafter may be omitted when color discrimination is not necessary.

Figure 2:
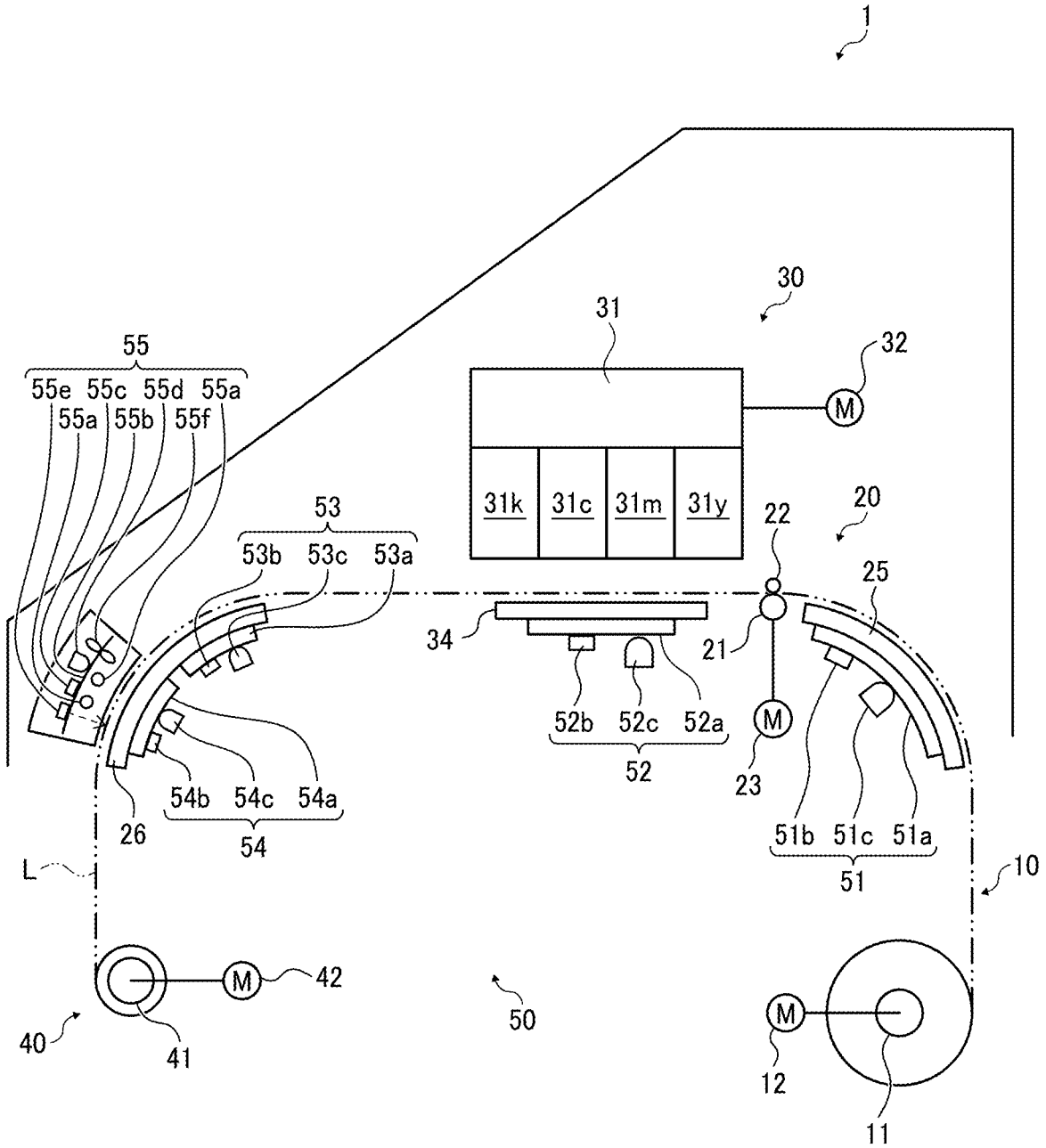
FIG. 2 is a cross-sectional view illustrating an interior of the inkjet recording apparatus in FIG. 1.
Figure 3:
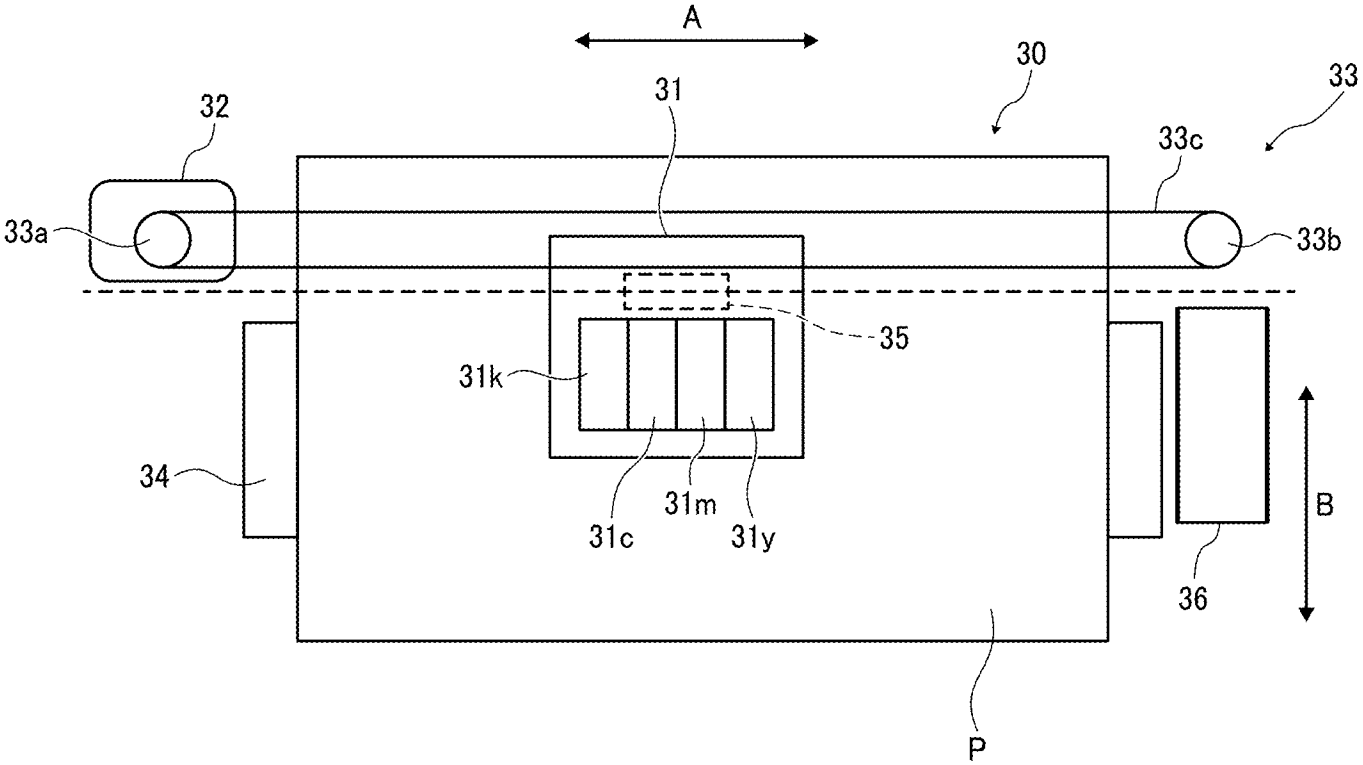
FIG. 3 is a plan view illustrating a detailed configuration of an image forming unit of the inkjet recording apparatus.
Figure 4:
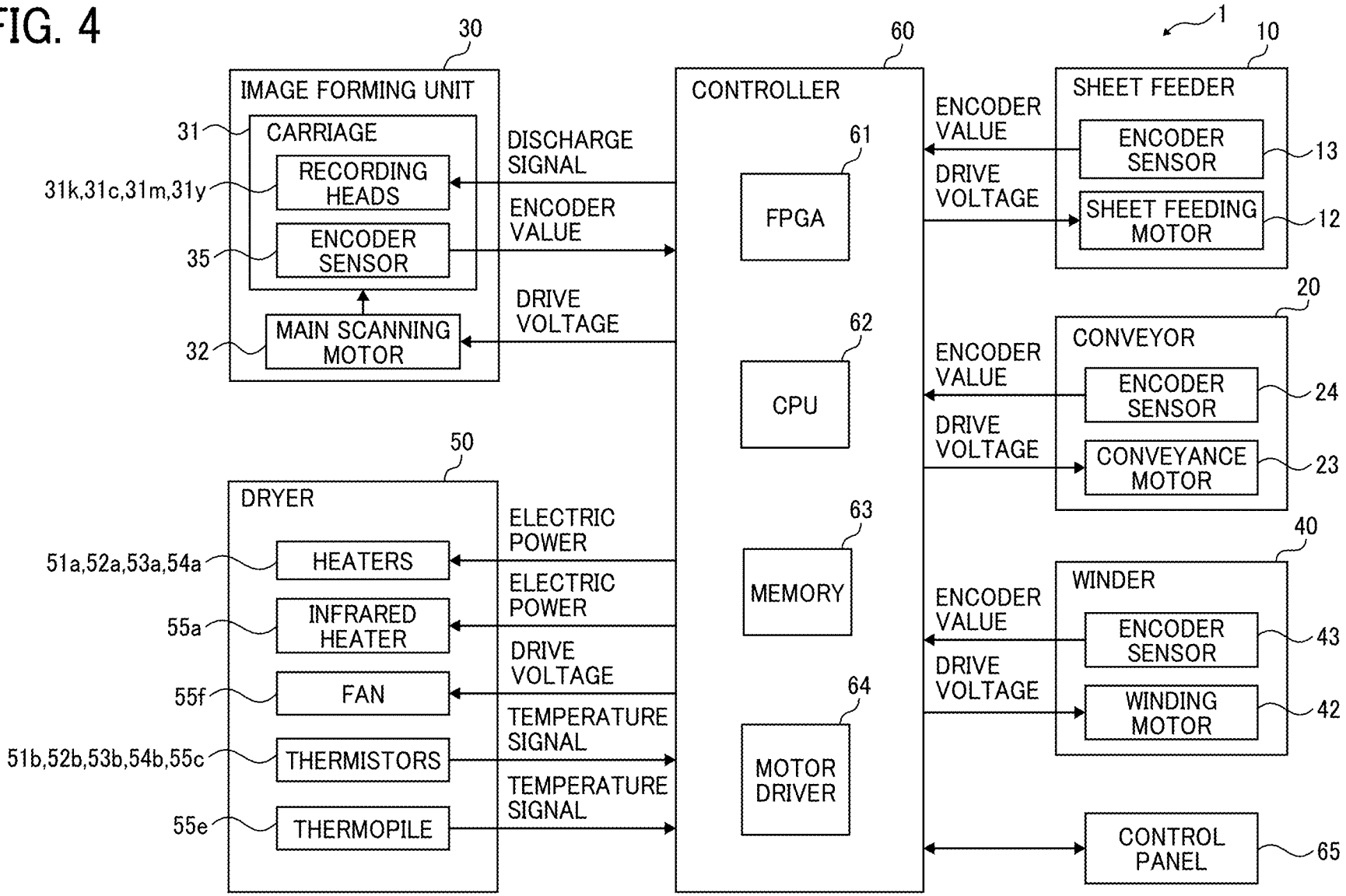
FIG. 4 is a block diagram illustrating a hardware configuration of the inkjet recording apparatus.

Hereinafter, a description is given of an inkjet recording apparatus 1 according to an embodiment of the present disclosure with reference to FIGS. 1 to 4. FIG. 1 is a perspective view illustrating a configuration of the inkjet recording apparatus 1. FIG. 2 is a cross-sectional view illustrating an interior of the inkjet recording apparatus 1. FIG. 3 is a plan view illustrating a detailed configuration of an image forming unit 30. FIG. 4 is a block diagram illustrating a hardware configuration of the inkjet recording apparatus 1.

The inkjet recording apparatus 1 according to the present embodiment is an image forming apparatus (liquid discharge apparatus) using an inkjet method, which discharges ink onto a continuous sheet P (medium) to form an image on the continuous sheet P. As illustrated in FIGS. 1 to 4, the inkjet recording apparatus 1 includes a sheet feeder 10, a conveyor 20, the image forming unit (liquid discharge unit) 30, a winder 40, a dryer 50, and a controller 60.

The continuous sheet P is a belt-shaped sheet. A material of the continuous sheet P refers to any medium, such as paper (paper sheet), an overhead projector (OHP) transparency, yarn, fiber, leather, metal, or plastic, on which ink (liquid) can adheres to form an image. When the present disclosure is applied to an "impermeable medium (for example, a film of acrylic, polyester, polyvinyl chloride, or the like)" through which the ink adhering to the medium does not permeate or a "slowly permeable medium (for example, coated paper)" through which the ink adhering to the medium does not easily permeate, in particular, advantageous effects can be attained. The "liquid" in the present disclosure is not limited to ink for forming an image, and may be a pretreatment liquid applied to a medium before forming the image, a post-treatment liquid applied to a medium after forming the image, or the like.

The sheet feeder 10 applies a predetermined tension to the continuous sheet P between the sheet feeder 10 and the conveyor 20. The sheet feeder 10 includes a sheet feeding roller 11, a sheet feeding motor 12, and an encoder sensor 13. The continuous sheet P before an image is formed is wound around the sheet feeding roller 11. As the controller 60 applies a drive voltage, the sheet feeding motor 12 rotates the sheet feeding roller 11 in a direction in which the continuous sheet P is wound around the sheet feeding roller 11. The encoder sensor 13 reads an amount of rotation of an encoder sheet that rotates together with an output shaft of the sheet feeding motor 12, and outputs a pulse signal indicating the amount of rotation to the controller 60.

The conveyor 20 conveys the continuous sheet P fed from the sheet feeder 10 along a conveyance path L. The conveyance path L is a space through which the continuous sheet P passes in the inkjet recording apparatus 1. The conveyance path L extends from the sheet feeder 10 to the winder 40 via a position facing the image forming unit 30. The conveyor 20 conveys the continuous sheet P in a conveyance direction that is the sub-scanning direction B illustrated in FIGS. 1 and 3. The conveyor 20 includes a conveyance roller 21, a pressure roller 22, a conveyance motor 23, and an encoder sensor 24.

The conveyance roller 21 and the pressure roller 22 rotate while nipping the continuous sheet P from both sides in the direction of thickness of the continuous sheet P. The conveyance motor 23 transmits a driving force to rotate the conveyance roller 21. The pressure roller 22 is pressed against the conveyance roller 21 with a predetermined pressure and rotated along with the rotation of the conveyance roller 21. The encoder sensor 24 reads an amount of rotation of an encoder sheet that rotates together with the conveyance roller 21, and outputs a pulse signal indicating the amount of rotation to the controller 60.

Guide plates 25 and 26 are disposed along a portion of the conveyance path L (for example, a curved portion) to guide the continuous sheet P conveyed. The guide plate 25 is disposed on the inner side of the curved portion of the conveyance path L upstream from the image forming unit 30 in the conveyance direction. The guide plate 26 is disposed on the inner side of the curved portion of the conveyance path L downstream from the image forming unit 30 in the conveyance direction. The guide plates 25 and 26 face (contact) the back surface of the continuous sheet P conveyed along the conveyance path L.

The image forming unit 30 is disposed downstream from the conveyor 20 in the conveyance direction of the continuous sheet P. The image forming unit 30 discharges ink onto the continuous sheet P conveyed in the sub-scanning direction B by the conveyor 20 to form an image on the continuous sheet P. As illustrated in FIGS. 1 to 3, the image forming unit 30 includes a carriage 31, a main scanning motor 32, a driving force transmitter 33, a platen 34, and an encoder sensor 35.

The carriage 31 reciprocates in the main scanning direction A along a guide rod 38*a* and a sub guide rail 38*b* extending in the main scanning direction A perpendicular to the sub-scanning direction B. Recording heads (discharge heads) 31*k*, 31*c*, 31*m*, and 31*y* that discharge inks of respective colors of black, cyan, magenta, and yellow are mounted on the carriage 31. The recording heads 31*k*, 31*c*, 31*m*, and 31*y* discharge the inks of the respective colors supplied from ink cartridges 39*k*, 39*c*, 39*m*, and 39*y* toward the continuous sheet P supported by the platen 34.

The driving force transmitter 33 transmits a driving force of the main scanning motor 32 to the carriage 31 to move the carriage 31 in the main scanning direction A. More specifically, the driving force transmitter 33 includes a drive pulley 33*a*, a pressure pulley 33*b*, and an endless annular timing belt 33*c*. The drive pulley 33*a* and the pressure pulley 33*b* are separated from each other in the main scanning direction A, and the timing belt 33*c* is looped around the drive pulley 33*a* and the pressure pulley 33*b*.

The drive pulley 33*a* is rotated by the driving force of the main scanning motor 32. Accordingly, the timing belt 33*c* rotates, and the carriage 31 attached to the timing belt 33*c* reciprocates in the main scanning direction A. The pressure pulley 33*b* applies a predetermined tension to the timing belt 33*c*.

The platen 34 upwardly faces the carriage 31. The platen 34 supports the continuous sheet P conveyed by the conveyor 20. The encoder sensor 35 is mounted on the carriage 31. The encoder sensor 35 reads an encoder sheet disposed at a position facing the carriage 31 and outputs a pulse signal indicating a reading value of the encoder sheet to the controller 60.

The winder 40 is disposed downstream from the conveyor 20 and the image forming unit 30 in the conveyance direction of the continuous sheet P. The winder 40 winds the continuous sheet P on which an image has been formed by the image forming unit 30. The winder 40 includes a winding roller 41, a winding motor 42, and an encoder sensor 43.

The continuous sheet P on which the image has been formed is wound around the winding roller 41. As the controller 60 applies a drive voltage, the winding motor 42 rotates the winding roller 41 in a direction in which the continuous sheet P is wound around the winding roller 41. The encoder sensor 43 reads an amount of rotation of an encoder sheet that rotates together with an output shaft of the winding motor 42, and outputs a pulse signal indicating the amount of rotation to the controller 60.

The dryer 50 heats the continuous sheet P to dry ink adhering to the continuous sheet P. The dryer 50 is supplied with power from the controller 60 and generates heat. The dryer 50 includes a preheater 51, a platen heater 52, a first post heater 53 (first contact heater), a second post heater 54 (second contact heater), and an infrared heating device 55.

Among the above-described heaters, the first post heater 53, the second post heater 54, and the infrared heating device 55 are disposed downstream from the image forming unit 30 in the conveyance direction of the continuous sheet P, and construct a medium heating device to heat the continuous sheet P that is conveyed on the conveyance path L with ink adhering to the front surface thereof.

The preheater 51 is disposed upstream from the image forming unit 30 in the conveyance direction. More specifically, the preheater 51 is attached to the back surface of the guide plate 25 (the surface opposite to the surface in contact with the continuous sheet P). The preheater 51 includes a heater 51*a*, a thermistor 51*b*, and a thermostat 51*c*.

The heater 51*a* is supplied with power from the controller 60 and generates heat. The heat generated by the heater 51*a* is transferred to the continuous sheet P via the guide plate 25. The thermistor 51*b* is a temperature sensor that detects the temperature of the heater 51*a* and outputs a temperature signal indicating the detected temperature to the controller 60. The thermostat 51*c* cuts off the power supplied from the controller 60 to the heater 51*a* when the heater 51*a* reaches a predetermined temperature.

The preheater 51 preliminarily heats the continuous sheet P before the image forming unit 30 forms an image on the continuous sheet P. Therefore, ink landed on the continuous sheet P can be quickly dried. The preheater 51 is an example of a contact heater that contacts the back surface of the continuous sheet P via the guide plate 25. The heater 51*a* may be embedded in the guide plate 25.

The platen heater 52 is disposed at a position upwardly facing the image forming unit 30. More specifically, the platen heater 52 is attached to the lower surface of the platen 34 (the surface opposite to the upper surface in contact with the continuous sheet P). The platen heater 52 includes a heater 52*a*, a thermistor 52*b*, and a thermostat 52*c*.

The heater 52*a* is supplied with power from the controller 60 and generates heat. The heat generated by the heater 52*a* is transferred to the continuous sheet P via the platen 34. The thermistor 52*b* is a temperature sensor that detects the temperature of the heater 52*a* and outputs a temperature signal indicating the detected temperature to the controller 60. The thermostat 52*c* cuts off the power supplied from the controller 60 to the heater 52*a* when the heater 52*a* reaches a predetermined temperature.

The platen heater 52 heats the continuous sheet P facing the image forming unit 30. Therefore, ink landed on the continuous sheet P can be quickly dried. As a result, moisture contained in the ink evaporates, and a film is formed on the surface of the ink (i.e., film-forming). The film-forming means that the surface of ink solidifies to form a film, and the ink is dried to the extent that the ink does not adhere to a hand even when the ink is touched with the hand. Since the spreadability and size of ink droplets (dots) are determined depending on the film-forming, the film-forming is also referred to as an "ink set." The platen heater 52 is an example of a contact heater that contacts the back surface of the continuous sheet P via the platen 34. The heater 52*a* may be embedded in the platen 34.

The first post heater 53 is disposed downstream from the image forming unit 30 in the conveyance direction. More specifically, the first post heater 53 is attached to the back surface of the guide plate 26 (the surface opposite to the surface in contact with the continuous sheet P). The first post heater 53 includes a heater 53*a*, a thermistor 53*b*, and a thermostat 53*c*.

The heater 53*a* is supplied with power from the controller 60 and generates heat. The heat generated by the heater 53*a* is transferred to the continuous sheet P via the guide plate 26. The thermistor 53*b* is a temperature sensor that detects the temperature of the heater 53*a* and outputs a temperature signal indicating the detected temperature to the controller 60. The thermostat 53*c* cuts off the power supplied from the controller 60 to the heater 53*a* when the heater 53*a* reaches a predetermined temperature.

The second post heater 54 is disposed downstream from the first post heater 53 in the conveyance direction. More specifically, the second post heater 54 is attached to the back surface of the guide plate 26 (the surface opposite to the surface in contact with the continuous sheet P). The second post heater 54 includes a heater 54*a*, a thermistor 54*b*, and a thermostat 54*c*.

The heater 54*a* is supplied with power from the controller 60 and generates heat. The heat generated by the heater 54*a* is transferred to the continuous sheet P via the guide plate 26. The thermistor 54*b* is a temperature sensor that detects the temperature of the heater 54*a* and outputs a temperature signal indicating the detected temperature to the controller 60. The thermostat 54*c* cuts off the power supplied from the controller 60 to the heater 54*a* when the heater 54*a* reaches a predetermined temperature.

The first post heater 53 and the second post heater 54 heat the continuous sheet P after the image forming unit 30 has formed an image on the continuous sheet P. Therefore, moisture and solvent of ink landed on the continuous sheet P can be evaporated. The first and second post heaters 53 and 54 are examples of a contact heater that contacts the back surface of the continuous sheet P via the guide plate 26. The heaters 53*a* and 54*a* may be embedded in the guide plate 26.

The infrared heating device 55 is disposed downstream from the image forming unit 30 in the conveyance direction. More specifically, the infrared heating device 55 is disposed at a position facing the second post heater 54 across the conveyance path L. The infrared heating device 55 includes an infrared heater 55*a*, a reflective panel 55*b*, a thermistor 55*c*, a thermostat 55*d*, a thermopile 55*e*, and a fan 55*f*.

The infrared heater 55*a* is supplied with power from the controller 60 and generates infrared rays (more specifically, far-infrared rays), which are an example of electromagnetic waves. The infrared heating device 55 may include one or more infrared heaters 55*a*. The reflective panel 55*b* reflects the infrared rays output from the infrared heater 55*a* toward the conveyance path L.

The thermistor 55*c* is a temperature sensor that detect the temperature of the infrared heating device 55 (more specifically, the reflective panel 55*b*) and output a temperature signal indicating the detected temperature to the controller 60. The thermostat 55*d* cuts off the power supplied from the controller 60 to the infrared heater 55*a* when the reflective panel 55*b* reaches a predetermined temperature.

The thermopile 55*e* is a temperature sensor that detects the temperature of the continuous sheet P passing through a position facing the infrared heating device 55 and outputs a temperature signal indicating the detected temperature to the controller 60. The fan 55*f* is supplied with a drive voltage from the controller 60 and rotates to generate an airflow. Such a configuration prevents the humidity in the conveyance path L from rising and facilitates the continuous sheet P being dried. In addition, the infrared heating device 55 is prevented from overheating.

The infrared heating device 55 is an example of a non-contact heater that heats the front surface of the continuous sheet P (that is, the surface to which ink adheres) at a position separated from the continuous sheet P on the conveyance path L. The infrared heating device 55 irradiates the surface of the continuous sheet P with infrared rays to cause a polymerization reaction of the resin inside the ink, thereby curing the ink.

Here, the contact heaters (i.e., the preheater 51, the platen heater 52, the first post heater 53, and the second post heater 54) dry the surface of ink, and a film is formed on the surface of the ink. As a result, moisture and solvent in the ink are less likely to evaporate. On the other hand, infrared rays emitted from the infrared heating device 55 penetrate into the ink to evaporate the moisture and solvent from the inside.

The controller 60 controls the operation of the inkjet recording apparatus 1. More specifically, the controller 60 controls the operations of the sheet feeder 10, the conveyor 20, the image forming unit 30, the winder 40, the dryer 50, and a control panel 65 to form an image on the continuous sheet P.

As illustrated in FIG. 4, the controller 60 includes a field programmable gate array (FPGA) 61, a central processing unit (CPU) 62, a memory 63, and a motor driver 64. The CPU 62 reads and executes a program stored in the memory 63 to configure a software control unit including various functional modules of the inkjet recording apparatus 1. The software control unit thus configured and the hardware resources installed in the inkjet recording apparatus 1, in combination, construct functional blocks that implement the function of the inkjet recording apparatus 1. In addition, a function can be customized for each inkjet recording apparatus 1 by the FPGA 61.

The controller 60 applies drive voltages via the motor driver 64 to the sheet feeding motor 12, the conveyance motor 23, the main scanning motor 32, the winding motor 42, and the motor for driving the fan 55*f*, to rotate the respective motors. The controller 60 outputs discharge signals to the recording heads 31*k*, 31*c*, 31*m*, and 31*y* to cause the recording heads 31*k*, 31*c*, 31*m*, and 31*y* to discharge ink. The controller 60 supplies power to each of the heaters 51*a*, 52*a*, 53*a*, 54*a*, and 55*a* to cause each of the heaters 51*a*, 52*a*, 53*a*, 54*a*, and 55*a* to generate heat independently.

The controller 60 counts the pulse signals output from each of the encoder sensors 13, 24, 35, and 43 (hereinafter, the counted number of pulse signals is referred to as an "encoder value"), and determines the amount of rotation of each motor or the movement of the corresponding component based on the encoder value. Further, the controller 60 determines the temperature of each part based on the temperature signals acquired from the thermistors 51*b*, 52*b*, 53*b*, 54*b*, and 55*c* , and thermopile 55*e*.

The control panel 65 includes, for example, a display that displays an image, a touch panel that detects an operator's operation of pressing a button displayed on the display, and a push button pressed by the operator. The controller 60 displays an image on the display and acquires an operation signal corresponding to an operation by the operator on the touch panel or the push button from the control panel 65.

Figure 5:
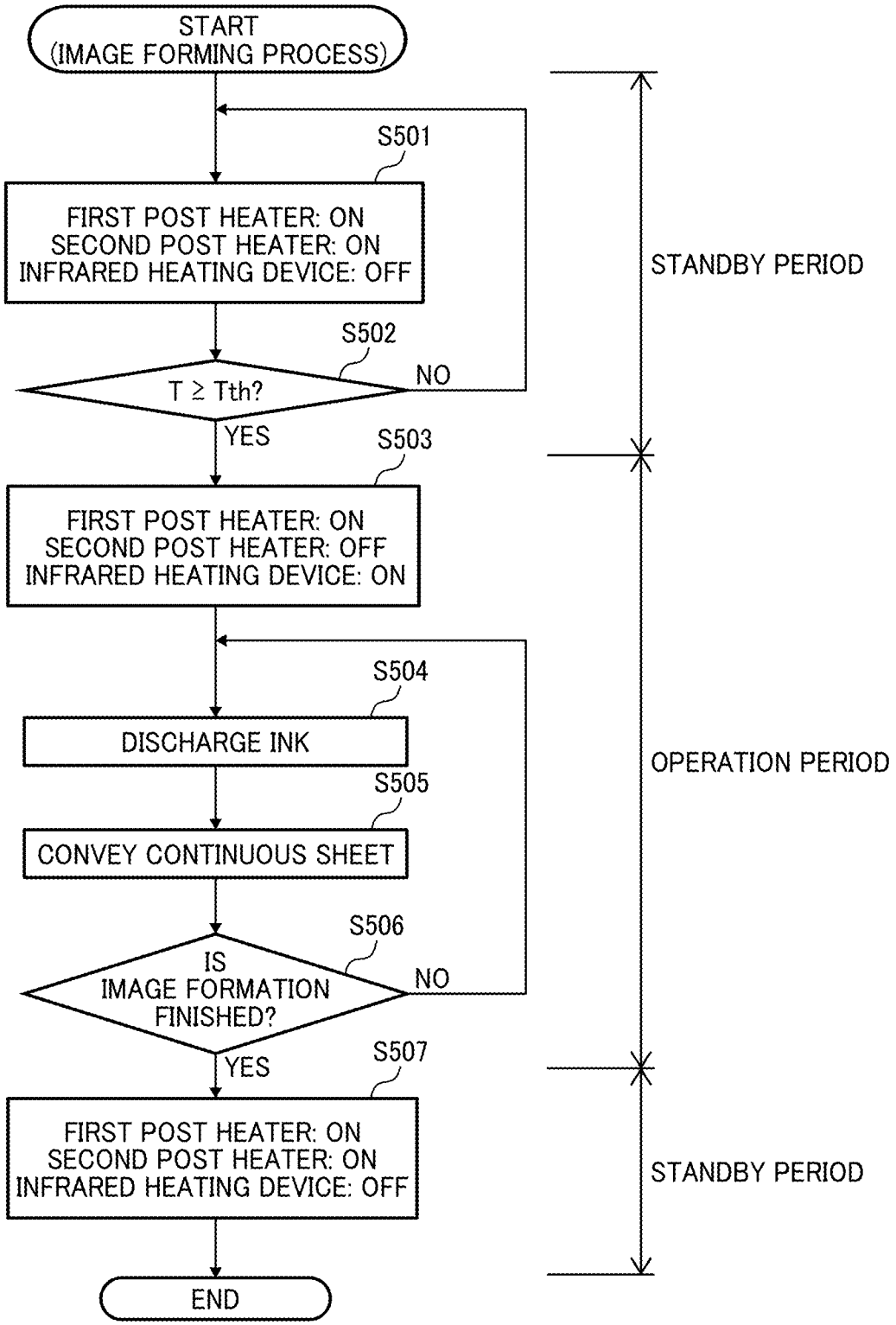
FIG. 5 is a flowchart of an image forming process according to an embodiment of the present disclosure.
Figure 6:
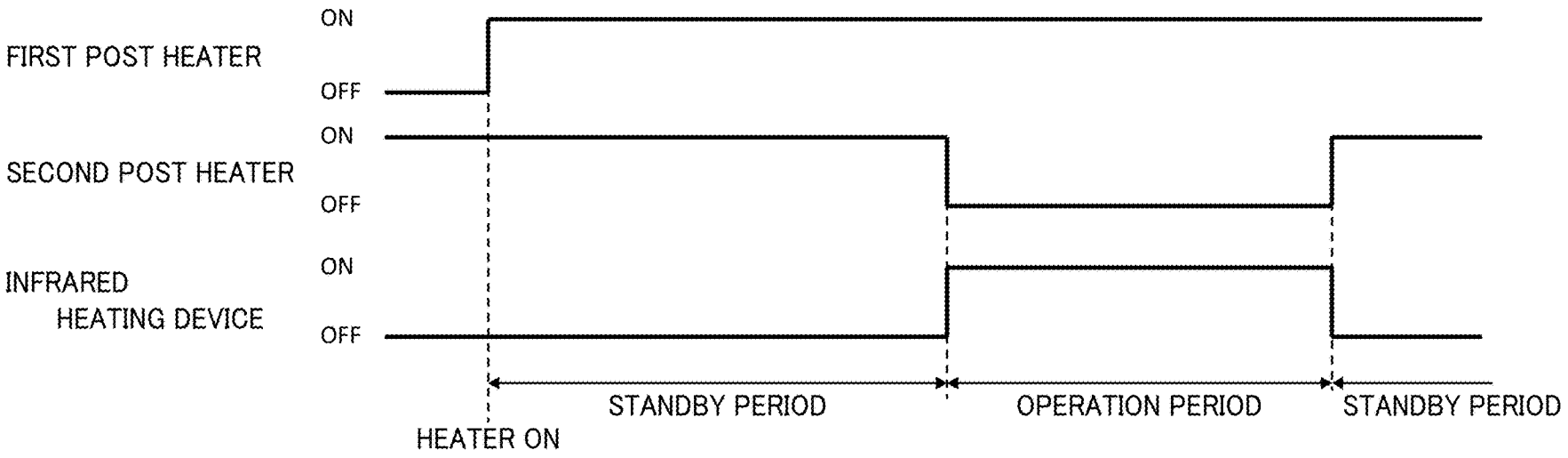
FIG. 6 is a time chart of power supplied to a first post heater, a second post heater, and an infrared heating device according to an embodiment of the present disclosure.

Next, an image forming process is described with reference to FIGS. 5 and 6. FIG. 5 is a flowchart of the image forming process. FIG. 6 is a time chart of power supplied to the first post heater 53, the second post heater 54, and the infrared heating device 55. The controller 60 starts the image forming process, for example, when the inkjet recording apparatus 1 is turned on, when the inkjet recording apparatus 1 returns from a sleep mode, or when the inkjet recording apparatus 1 (controller 60) receives an instruction to form an image.

First, the controller 60 starts supplying power to the first post heater 53 and the second post heater 54, and does not supply power to the infrared heating device 55 (S501). Thus, the heaters 53*a* and 54*a* generate heat, and the infrared heater 55*a* does not output infrared rays. In the drawings, a state in which power is supplied is referred to as "ON", and a state in which power is not supplied is referred to as "OFF." The controller 60 also starts supplying power to the preheater 51 and the platen heater 52.

Next, the controller 60 compares the temperature T of the heater 54*a* detected by the thermistor 54*b* with a predetermined threshold temperature Tth (S502). Then, the controller 60 is on standby for execution of subsequent processes until the temperature T becomes equal to or higher than the threshold temperature Tth (No in S502). Thus, the guide plate 26 is preheated.

Even if an instruction to form an image on the continuous sheet P (hereinafter, referred to as a "print job") is input to the inkjet recording apparatus 1 (controller 60), the controller 60 does not execute the processes after step S503 until the temperature T becomes equal to or higher than the threshold temperature Tth. On the other hand, if the temperature T becomes equal to or higher than the threshold temperature Tth before the print job is input, the controller 60 increases or decreases the power supplied to the heater 54*a* so that the temperature T is maintained at the threshold temperature Tth.

Next, when the print job is input and the temperature T reaches the threshold temperature Tth (Yes in S502), the controller 60 continues supplying power to the first post heater 53, stops supplying power to the second post heater 54, and starts supplying power to the infrared heating device 55 (S503). The controller 60 also starts supplying a drive voltage to the fan 55*f*.

Subsequently, the controller 60 drives the main scanning motor 32 to move the carriage 31 in the main scanning direction A and outputs discharge signals to the recording heads 31*k*, 31*c*, 31*m*, and 31*y* at a predetermined timing (S504). Then, the controller 60 drives the sheet feeding motor 12, the conveyance motor 23, and the winding motor 42 to convey the continuous sheet P in the conveyance direction by a predetermined distance of conveyance (S505).

Next, the controller 60 determines whether all the images have been formed on the continuous sheet P (S506). As the controller 60 determines that the image formation is not finished yet (No in S506), the controller 60 executes the processes in step S504 and beyond again.

That is, the controller 60 repeats the processes in steps S504 to S505 to form an image instructed by the print job on the continuous sheet P. More specifically, the controller 60 forms the image on a region of the continuous sheet P facing the image forming unit 30 while intermittently conveying the continuous sheet P by the predetermined distance of conveyance.

As the controller 60 determines that the image formation is completely finished (Yes in S506), the controller 60 continues supplying power to the first post heater 53, starts supplying power to the second post heater 54, and stops supplying power to the infrared heating device 55 (S507). The controller 60 also stops supplying the drive voltage to the fan 55*f*.

A period until the temperature T becomes equal to or higher than the threshold temperature Tth (S501 to S502) and a period after the image formation is finished (S507) are referred to as "standby periods." A period from when the temperature T becomes equal to or higher than the threshold temperature Tth to when the image formation is finished (S503 to S506) is an "operation period." That is, the period in which the controller 60 executes steps S504 and S505 corresponds to the "operation period", and the other period corresponds to the "standby period."

In the standby period, the controller 60 supplies power to the second post heater 54 and stops supplying power to the infrared heating device 55. In the operation period, the controller 60 stops supplying power to the second post heater 54 and supplies power to the infrared heating device 55. Further, the controller 60 transitions from the standby period to the operation period after the print job (instruction to intermittently convey the continuous sheet P) is input and the temperature T reaches the threshold temperature Tth (Yes in S502).

According to the above-described embodiment, the following operational effects, for example, are achieved.

Figure 7A:
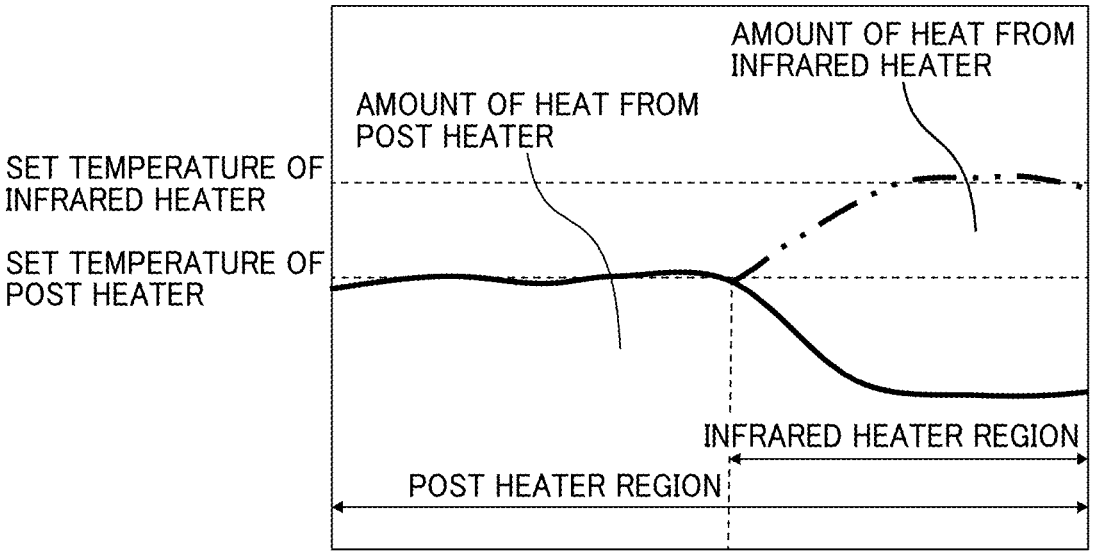
FIGS. 7A and 7B are graphs illustrating change of an amount of heat supplied to a continuous sheet from the first post heater, the second post heater, and the infrared heating device.
Figure 7B:
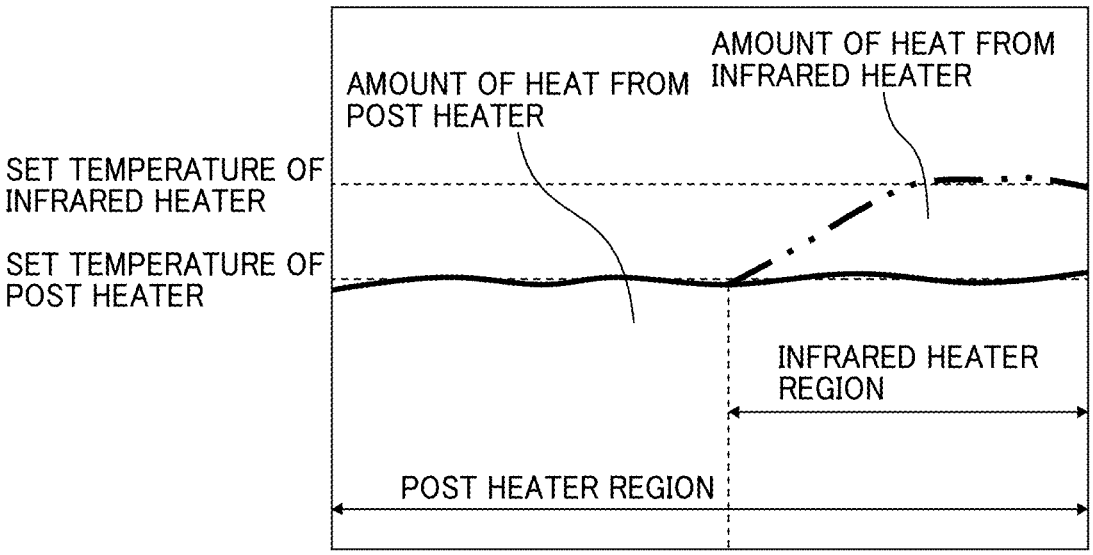

FIGS. 7A and 7B are graphs illustrating change of an amount of heat supplied to the continuous sheet P from the first post heater 53, the second post heater 54, and the infrared heating device 55. More specifically, FIG. 7A illustrates an example (the present embodiment) in which power is supplied to the first post heater 53 and the infrared heating device 55 and power supplied to the second post heater 54 is stopped in the operation period. FIG. 7B illustrates an example (comparative example) in which power is supplied to all of the first post heater 53, the second post heater 54, and the infrared heating device 55 in the operation period.

In the operation period, when the power supplied to the second post heater 54 is stopped as illustrated in FIG. 7A, the total amount of heat supplied to the continuous sheet P can be restricted as compared with the case in which the power supply to the second post heater 54 is continued as illustrated in FIG. 7B. Thus, according to the above-described embodiment, the continuous sheet P can be prevented from being deformed and damaged.

In FIGS. 7A and 7B, the amount of heat supplied from the infrared heating device 55 to the continuous sheet P is the same. Further, since the second post heater 54 is preheated to the temperature T in the standby period, the continuous sheet P can be heated from the back surface even when the power supply to the second post heater 54 is stopped in the operation period. As a result, the continuous sheet P can be heated from the back surface while the contribution of the infrared heating device 55 is increased, and thus the continuous sheet P can be efficiently dried.

A description is given of a first variation.

Figure 8:
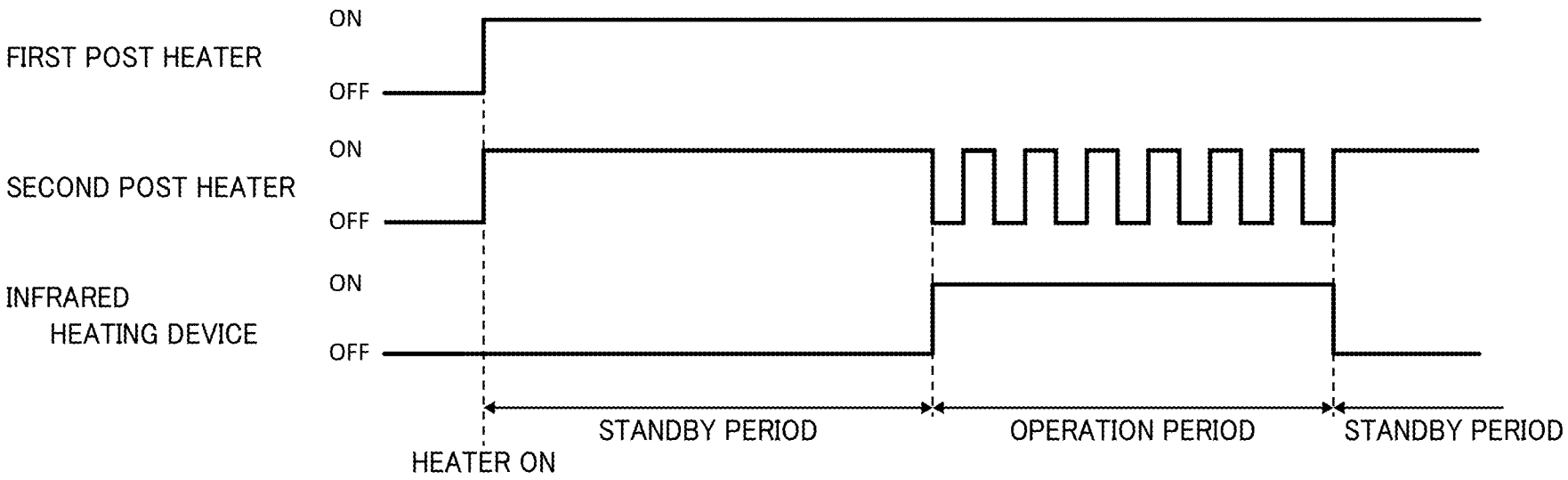
FIG. 8 is a time chart of the power supplied to the first post heater, the second post heater, and the infrared heating device according to a first variation of the present disclosure.

FIG. 8 is a time chart of power supply to the first post heater 53, the second post heater 54, and the infrared heating device 55 according to the first variation. Note that a detailed description of common points with the above-described embodiment is omitted, and differences are mainly described. The inkjet recording apparatus 1 according to the first variation is different from the above-described embodiment in the method of power supply to the second post heater 54 in the operation period, and is common to the above-described embodiment in the other points.

As illustrated in FIG. 8, the controller 60 according to the first variation repeats the power supply (ON) and stop (OFF) to the second post heater 54 at predetermined time intervals in the operation period (i.e., low duty supply). That is, in the operation period, the controller 60 sets the total power (second power) supplied to the second post heater 54 to be smaller than the total power (first power) supplied to the first post heater 53.

Accordingly, the temperature of the second post heater 54 is prevented from dropping while the amount of heat supplied to the continuous sheet P is restricted in the operation period. As a result, the inkjet recording apparatus 1 can efficiently dry ink adhering to the continuous sheet P while preventing the continuous sheet P from being deformed and damaged. That is, the controller 60 is not limited to completely stopping the second power (i.e., setting the second power to 0) supplied to the second post heater 54 in the operation period, and may set the second power to be smaller than the first power supplied to the first post heater 53.

A description is given of a second variation.

Figure 9:
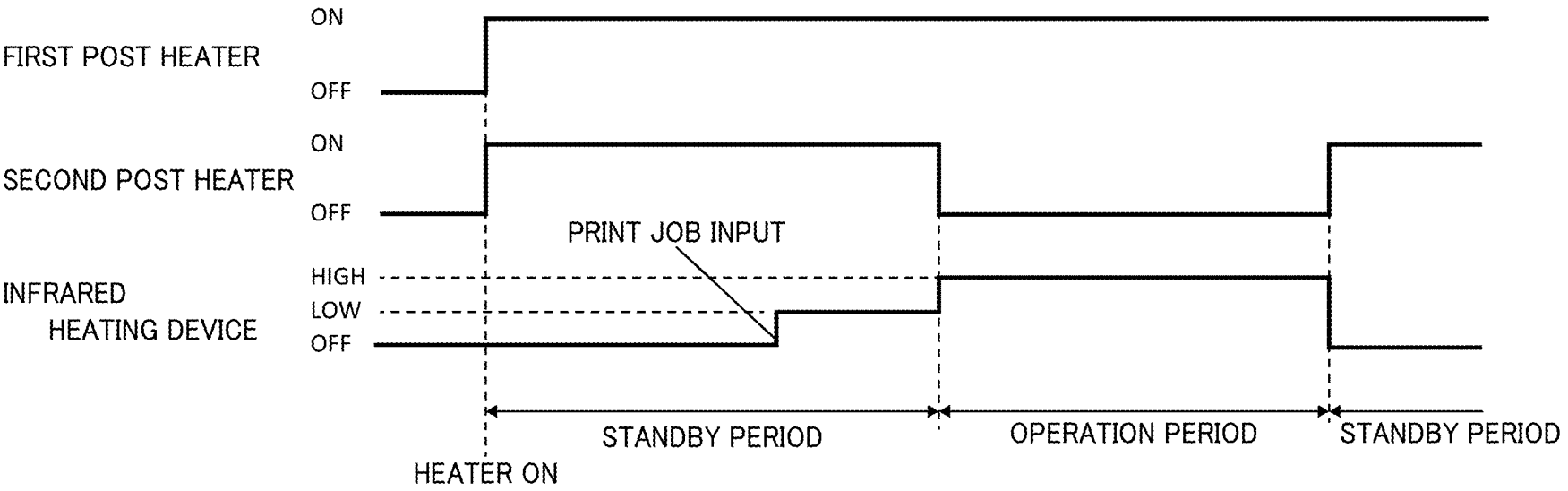
FIG. 9 is a time chart of the power supplied to the first post heater, the second post heater, and the infrared heating device according to a second variation of the present disclosure.

FIG. 9 is a time chart of power supply to the first post heater 53, the second post heater 54, and the infrared heating device 55 according to the second variation. Note that a detailed description of common points with the above-described embodiment is omitted, and differences are mainly described. The inkjet recording apparatus 1 according to the second variation is different from the above-described embodiment in the method of power supply to the infrared heating device 55 in the standby period, and is common to the above-described embodiment in the other points.

As illustrated in FIG. 9, in the standby period, the controller 60 according to the second variation stops supplying power to the infrared heating device 55 before a print job is input, and supplies low power to the infrared heating device 55 after the print job is input. In addition, the controller 60 according to the second variation supplies high power larger than the low power to the infrared heating device 55 in the operation period.

According to the second variation, since the infrared heating device 55 can be preheated, the continuous sheet P can be dried more efficiently. That is, the controller 60 is not limited to completely stopping the power (i.e., setting the power to 0) supplied to the infrared heating device 55 in the standby period, and may set the power to be smaller than the high power supplied in the operation period.

A description is given of a third variation.

Figure 10:
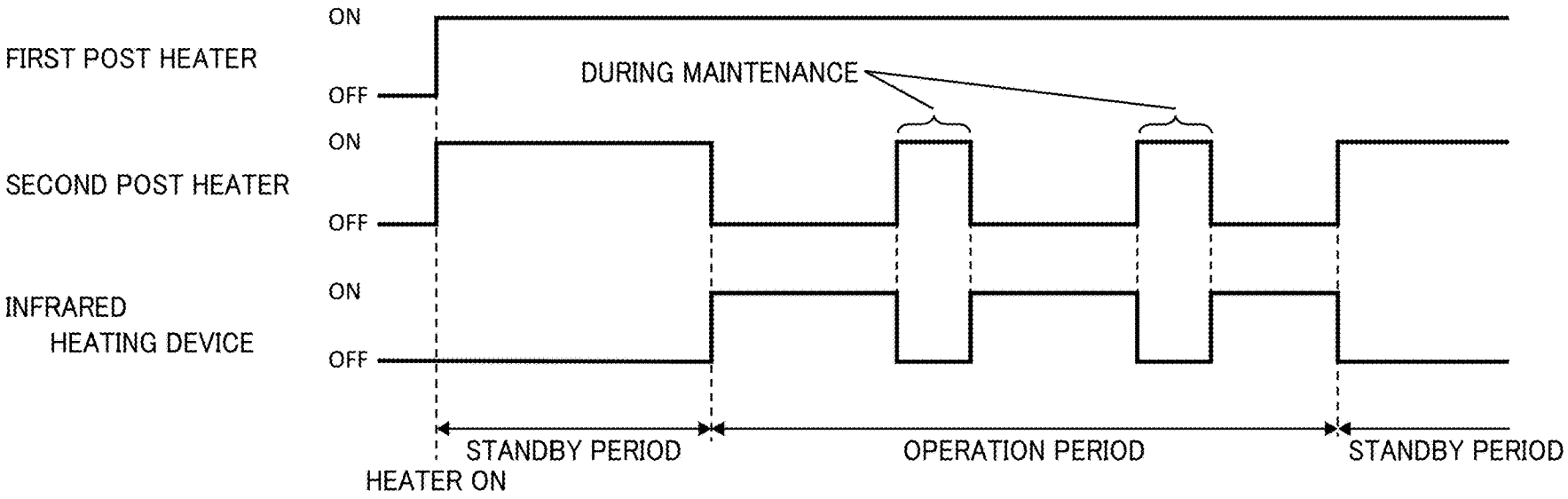
FIG. 10 is a time chart of the power supplied to the first post heater, the second post heater, and the infrared heating device according to a third variation of the present disclosure.

FIG. 10 is a time chart of power supply to the first post heater 53, the second post heater 54, and the infrared heating device 55 according to the third variation. Note that a detailed description of common points with the above-described embodiment is omitted, and differences are mainly described. The inkjet recording apparatus 1 according to the third variation is different from the above-described embodiment in the method of power supply to the second post heater 54 and the infrared heating device 55 in the operation period, and is common to the above-described embodiment in the other points.

The inkjet recording apparatus 1 includes a maintenance mechanism 36 that maintains the recording heads 31*k*, 31*c*, 31*m*, and 31*y*. The maintenance mechanism 36, for example, wipes a nozzle surface of the recording heads 31*k*, 31*c*, 31*m*, and 31*y* or sucks ink from the recording heads 31*k*, 31*c*, 31*m*, and 31*y*. The maintenance mechanism 36 is disposed at a position outside the conveyance path L of the continuous sheet P in the range where the carriage 31 is movable.

According to the third variation, while the controller 60 repeats steps S504 to S506, the image forming unit 30 performs an image forming operation (discharge operation) and a maintenance operation. In the image forming operation, the controller 60 causes the recording heads 31*k*, 31*c*, 31*m*, and 31*y* to discharge ink toward the continuous sheet P on the conveyance path L. In the maintenance operation, the controller 60 causes the carriage 31 to move to the position outside the conveyance path L of the continuous sheet P and causes the maintenance mechanism 36 to maintain the recording heads 31*k*, 31*c*, 31*m*, and 31*y*. More specifically, the controller 60 may cause the image forming unit 30 to perform the maintenance operation when the number of performances of the image forming operation reaches a threshold number.

As illustrated in FIG. 10, during the maintenance operation, the controller 60 according to the third variation adjusts power supplied to the second post heater 54 so that the temperature T detected by the thermistor 54*b* approaches the threshold temperature Tth, and stops supplying power to the infrared heating device 55.

On the other hand, the controller 60 according to the third variation stops supplying power to the second post heater 54 and supplies power to the infrared heating device 55 during operations other than the maintenance operation in the operation period. The other operations include, for example, the image forming operation and a conveyance operation of conveying the continuous sheet P by the conveyor 20.

According to the third variation, the temperature of the second post heater 54 is prevented from dropping while the amount of heat supplied to the continuous sheet P is restricted in the operation period. As a result, the inkjet recording apparatus 1 can efficiently dry ink adhering to the continuous sheet P while preventing the continuous sheet P from being deformed and damaged. In the third variation, the controller 60 may reduce power supplied to the second post heater 54 or the infrared heating device 55 instead of completely stopping the power (i.e., setting the power to 0).

As described above, according to the present disclosure, a liquid discharge apparatus (medium heating device) can efficiently dry a liquid adhering to a medium while preventing the medium from being deformed or damaged.

Note that the present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. A medium heating device, comprising:

a conveyance path along which a medium is conveyed, the medium having a front surface to which a liquid adheres and a back surface opposite to the front surface;

a first contact heater configured to contact the back surface of the medium;

a second contact heater downstream from the first contact heater in a conveyance direction of the medium, the second contact heater configured to contact the back surface of the medium;

a non-contact heater facing the second contact heater across the conveyance path, the non-contact heater configured to heat the front surface of the medium at a position separated from the medium on the conveyance path; and circuitry configured to supply power to each of the first contact heater, the second contact heater, and the non-contact heater to generate heat, wherein in an operation period in which the medium is intermittently conveyed on the conveyance path, the circuitry supplies the power to each of the first contact heater, the second contact heater, and the non-contact heater, and the power supplied to the second contact heater is smaller than the power supplied to the first contact heater, and during a portion of time of the operation period, the second contact heater is not supplied power while the non-contact heater is supplied the power.

2. The medium heating device according to claim 1, wherein the circuitry is configured to supply power to the first contact heater and stop supplying power to the second contact heater in the operation period.

3. The medium heating device according to claim 1, further comprising:

a temperature sensor configured to detect a temperature of the second contact heater, wherein the circuitry is further configured to:

supply power to the second contact heater in a standby period in which the medium is stopped from being intermittently conveyed; and transition from the standby period to the operation period as an instruction to intermittently convey the medium is input to the circuitry after the temperature detected by the temperature sensor reaches a threshold temperature.

4. The medium heating device according to claim 1, wherein the circuitry is configured to set power supplied to the non-contact heater in a standby period in which the medium is stopped from being intermittently conveyed, to be smaller than the power supplied to the non-contact heater in the operation period or to be 0.

5. A liquid discharge apparatus comprising:

a conveyor configured to convey a medium along a conveyance path;

a liquid discharge unit configured to discharge a liquid onto the medium conveyed by the conveyor; and the medium heating device according to claim 1, disposed downstream from the liquid discharge unit in the conveyance direction of the medium.

6. The liquid discharge apparatus according to claim 5, further comprising:

a temperature sensor configured to detect a temperature of the second contact heater;

and a maintenance mechanism configured to maintain the liquid discharge unit, wherein the liquid discharge unit includes:

a carriage configured to move in a main scanning direction perpendicular to the conveyance direction of the medium; and a discharge head mounted on the carriage and configured to discharge the liquid, in the operation period, the liquid discharge unit performs a discharge operation in which the discharge head discharges the liquid toward the medium and a maintenance operation in which the carriage moves to a position outside the conveyance path of the medium and the maintenance mechanism maintains the discharge head, and during the maintenance operation, the circuitry adjusts the power supplied to the second contact heater to cause the temperature detected by the temperature sensor to approach a threshold temperature, and set the power supplied to the non-contact heater to be smaller than the power supplied to the non-contact heater during the discharge operation or to be 0.

* * * * *